US006120020A

United States Patent [19]

Asao

[11] Patent Number: 6,120,020

[45] Date of Patent: Sep. 19, 2000

[54] SHEET POST-PROCESSING DEVICES

[75] Inventor: Yuusuke Asao, Yamanashi-ken, Japan

[73] Assignee: Nisca Corporation, Yamanashi, Japan

[21] Appl. No.: 09/049,028

[22] Filed: Mar. 27, 1998

[30] Foreign Application Priority Data

Mar. 31, 1997 [JP] Japan ..... 9-097962

[51] Int. Cl.[7] ..... B65H 29/34; B65H 33/04

[52] U.S. Cl. ..... 271/189; 270/58.08

[58] Field of Search ..... 270/58.08, 58.18, 270/58.27; 399/407; 271/189

[56] References Cited

U.S. PATENT DOCUMENTS

| | | | |
|---|---|---|---|
| 5,021,837 | 6/1991 | Uto et al. | 355/322 |
| 5,044,618 | 9/1991 | Ettischer et al. | 270/53 X |
| 5,241,355 | 8/1993 | Yamashita et al. | 355/324 X |
| 5,435,535 | 7/1995 | Suzuki et al. | 270/53 X |
| 5,772,197 | 6/1998 | Aoki et al. | 270/58.08 |
| 5,826,158 | 10/1998 | Hirano et al. | 399/410 X |

FOREIGN PATENT DOCUMENTS

| | | |
|---|---|---|
| 61-229769 | 10/1986 | Japan . |
| 2-279388 | 11/1990 | Japan . |
| 6-009144 | 1/1994 | Japan . |
| 7-129038 | 5/1995 | Japan . |
| 9-221260 | 8/1997 | Japan . |
| 9-221263 | 8/1997 | Japan . |

*Primary Examiner*—Christopher P. Ellis
*Assistant Examiner*—Kenneth W Bower
*Attorney, Agent, or Firm*—Kaensaka & Takeuchi

[57] ABSTRACT

A sheet post-processing device includes a storing tray for storing a sheet, and a process tray for post-processing the sheet. The sheet post-processing device has a first mode for guiding the sheet from an image forming device to the storing tray, and a second mode for guiding the sheet from the image forming device to the process tray and guiding the sheet to the storing tray after predetermined post-processing is operated. A guide device is formed in the sheet post-processing device for guiding the sheet from the image forming device to allow the sheet to pass at a portion spaced from the sheet placing surface of the process tray and to reach the storing tray. The guide means is transferred to a position for guiding the sheet to the storing tray in case of the first mode, and is transferred to a position to allow the sheet to be placed on the sheet placing surface of the process tray in case of the second mode.

12 Claims, 8 Drawing Sheets

SHEET POST-PROCESSING DEVICES

BACKGROUND OF THE INVENTION AND RELATED ART STATEMENT

The present invention relates to a terminal mechanism, such as a copier and printer, and more specifically to a sheet post-processing device which includes means for post-processing, such as stapling or punching, with respect to prints, such as documents.

In case prints formed by an image forming device such as a printer or a copier are automatically stapled to provide a set of the sheets, after aligning end sides of sheets successively stacked on a process tray for temporarily stacking the sheets in order to operate this process, the sheets are stapled by stapling means. This stapled set of the sheets is transferred to another stacking tray to be stacked thereon, and after stacking further sheets, stapling the set of the sheets continues to be operated. At this time, there is a demand that the following set of the sheets is apparently distinguished from the preceding set of the sheets by carrying out a jog operation to shift the following set of the sheets from the preceding set of sheets. Conventionally, to achieve the above object, a jog operation has been achieved by changing a central position of aligning means, which aligns the sheet in the width direction for operating a post-process.

However, for example, in case of performing the jog operation sheet by sheet, since the jog operation can be started only when the sheet lands on the process tray, this landing time deteriorates productivity of the sheet post-processing device. Or, even when the post-process including the jog operation is not necessary, this landing time has to be wasted. Actually, although this period of time is one second or less, need of the image forming device for improving productivity by reducing intervals of the sheets to the limit should not be impaired.

An object of the present invention is to propose an embodiment in which productivity of ejecting sheets onto a stacking tray without post-processing is improved by providing a guide in a sheet transfer path, and which can perform a jog operation.

SUMMARY OF THE INVENTION

To achieve the above object, a sheet post-processing device according to the present invention is formed of a process tray for stacking a sheet thereon; ejecting means for ejecting the sheet from the image forming device to the process tray; post-processing means for carrying out a post-process to the sheet on the process tray; a storing tray for storing the sheet post-processed by the post-processing means; moving means for transferring the sheet on the process tray to the storing tray; and guide means for allowing the sheet ejected from the ejecting means to pass above a sheet placing surface of the process tray and for guiding the same to the moving means.

Also, a sheet post-processing device is provided with the storing tray for storing the sheet and the process tray for carrying out the post-process to the sheet, and has a first mode for guiding the sheet from the image forming device to the storing tray, and a second mode for guiding the sheet from the image forming device to the process tray, and guiding the same to the storing tray after carrying out the predetermined post-process; and is further provided with guide means for allowing the sheet from the image forming device to pass above the sheet placing surface of the process tray and for guiding the same to the storing tray; wherein in case of the first mode, the guide means is transferred to a position for guiding the sheet to the storing tray, and in case of the second mode, the guide means is transferred to a position retreated from the sheet placing surface of the process tray.

Further, the sheet post-processing device is formed of the process tray for stacking the sheet; the ejecting means for ejecting the sheet from the image forming device to the process tray; the post-processing means for carrying out the post-process to the sheet on the process tray; the storing tray for storing the sheet post-processed by the post-processing means; moving means for transferring the sheet on the process tray to the storing tray; and the guide means for transferring the sheet ejected from the ejecting means in a direction perpendicularly to a sheet ejection direction above the sheet placing surface of the process tray so as to guide the same to the moving means.

DETAILED DESCRIPTION OF PREFERRED EMBODIMENTS

Figure 1:
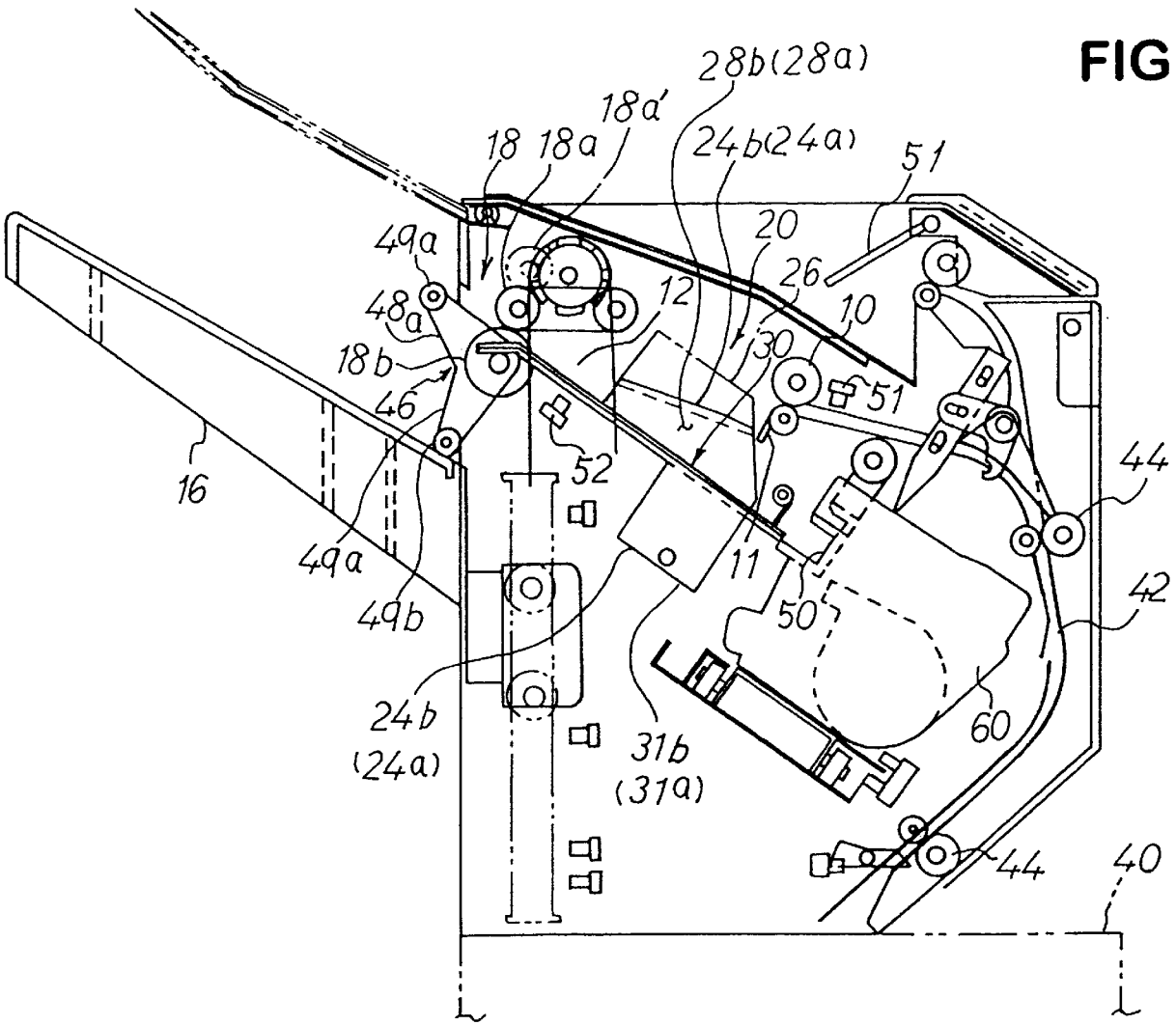
FIG. 1 is a schematic side view showing a sheet post-processing device of the invention.
Figure 2:
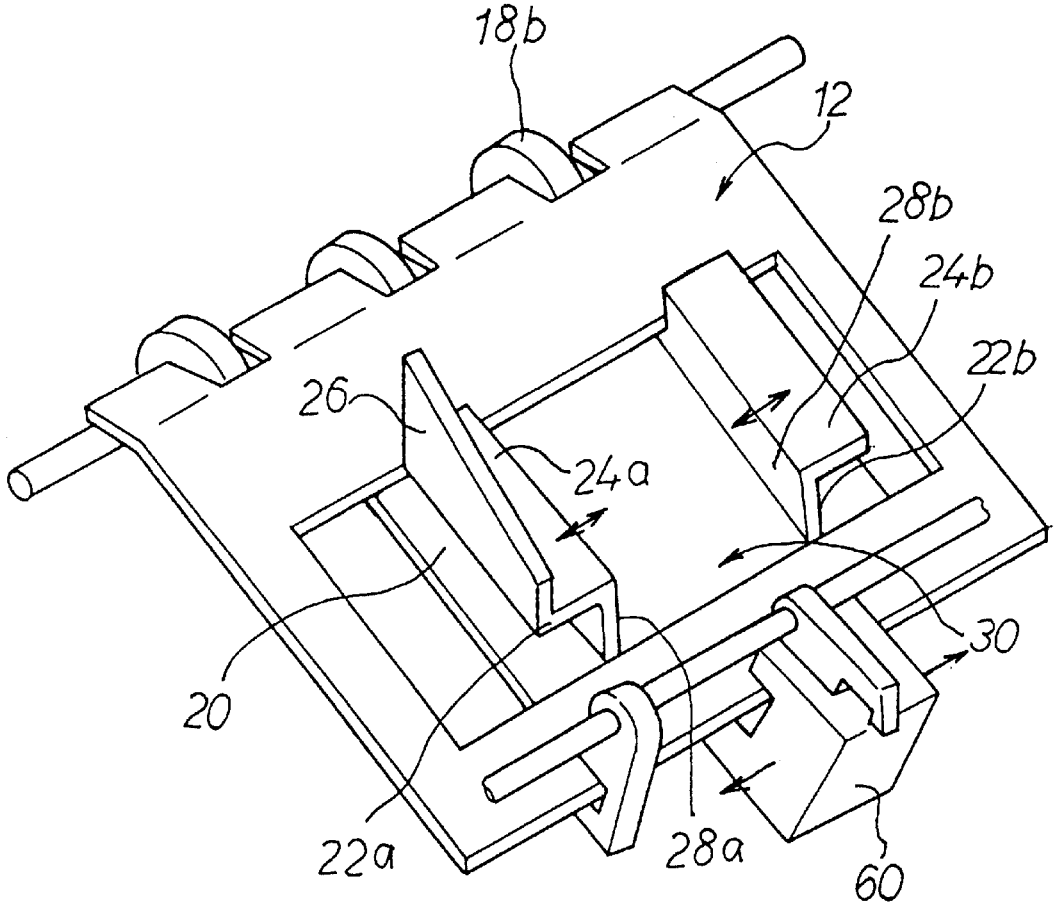
FIG. 2 is a schematic perspective view showing aligning means in the sheet post-processing device of the invention.
Figure 3A:
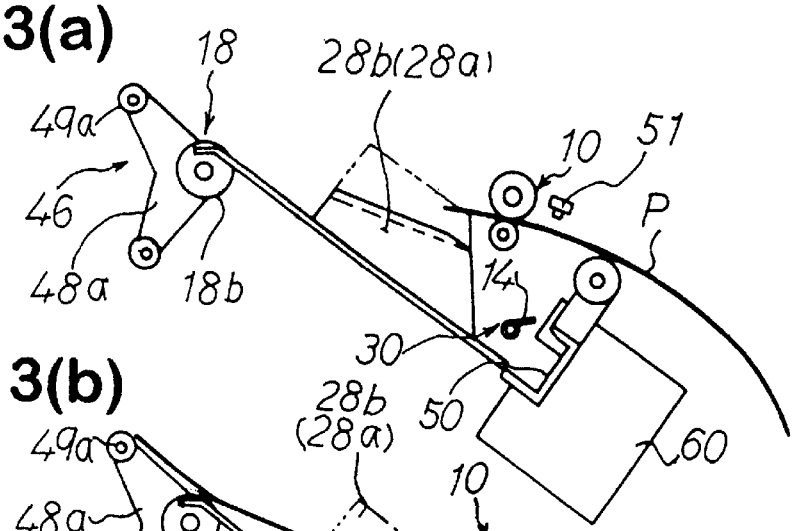
FIG. 3(*a*) through FIG. 3(*d*) are operation explanatory views of aligning means of a first mode in the sheet post-processing device according to the present invention.
Figure 3B:
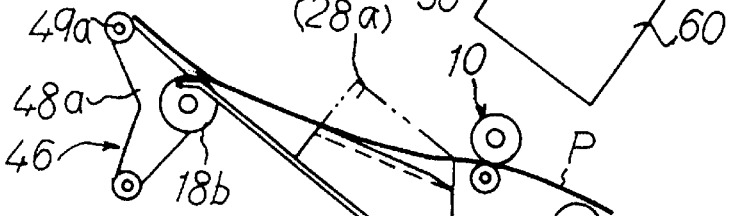
Figure 3C:
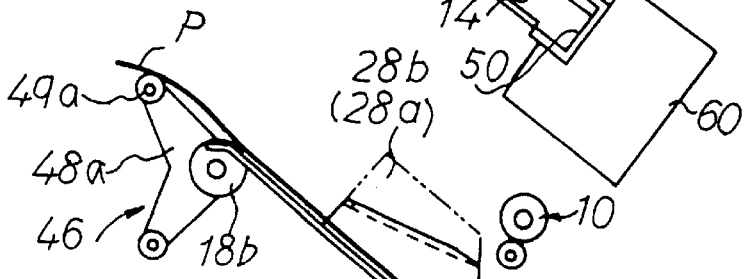
Figure 3D:
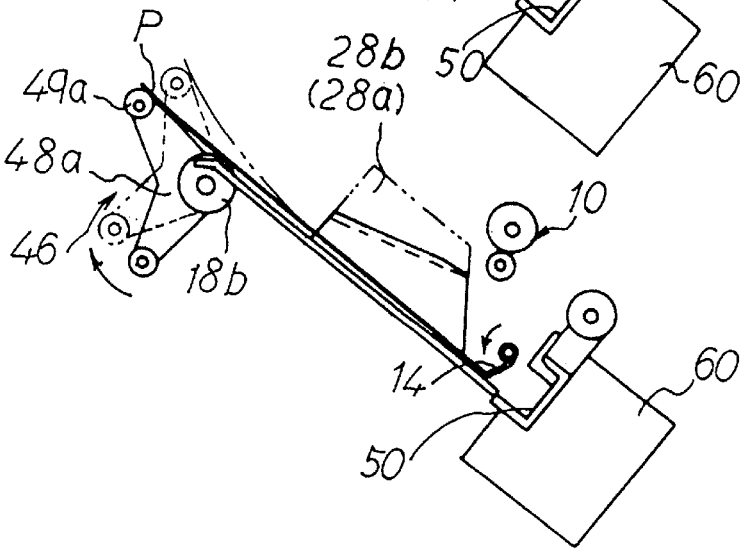
Figure 4A:
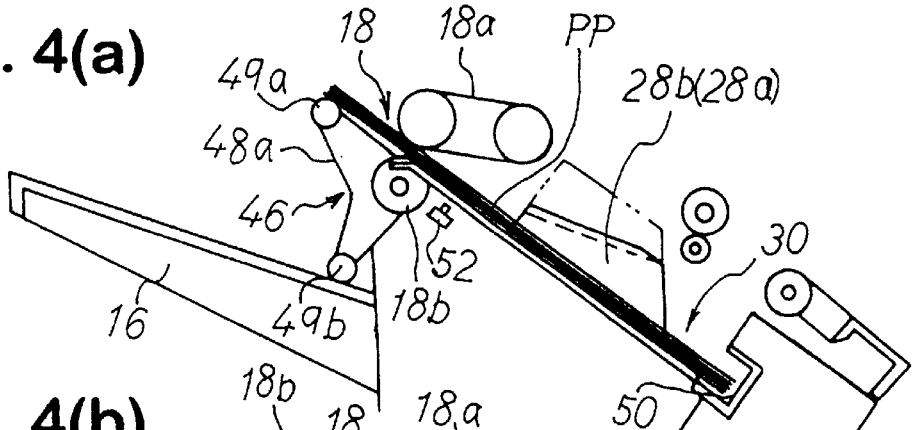
FIG. 4(*a*) through FIG. 4(*d*) are operation explanatory views of the aligning means of the first mode in the sheet post-processing device according to the present invention.
Figure 4B:
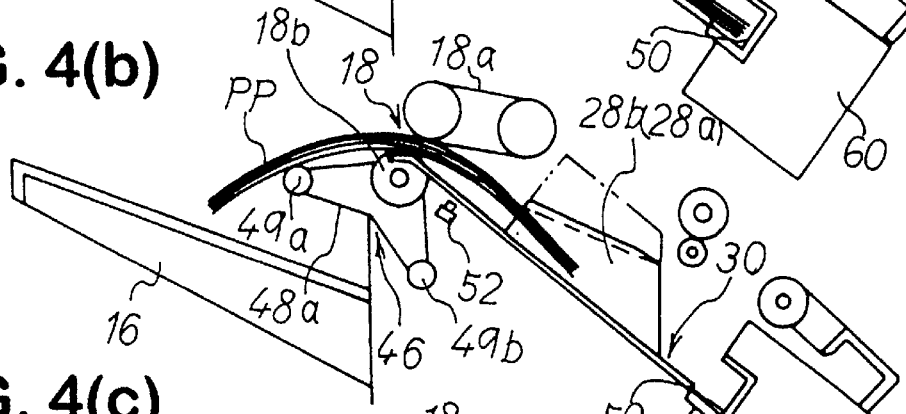
Figure 4C:
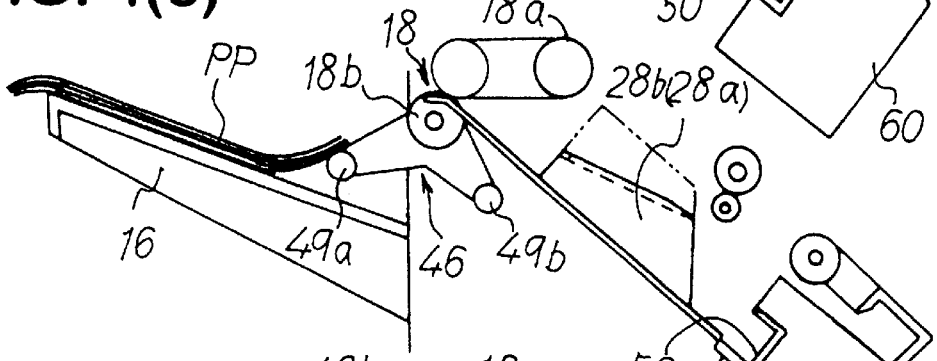
Figure 4D:
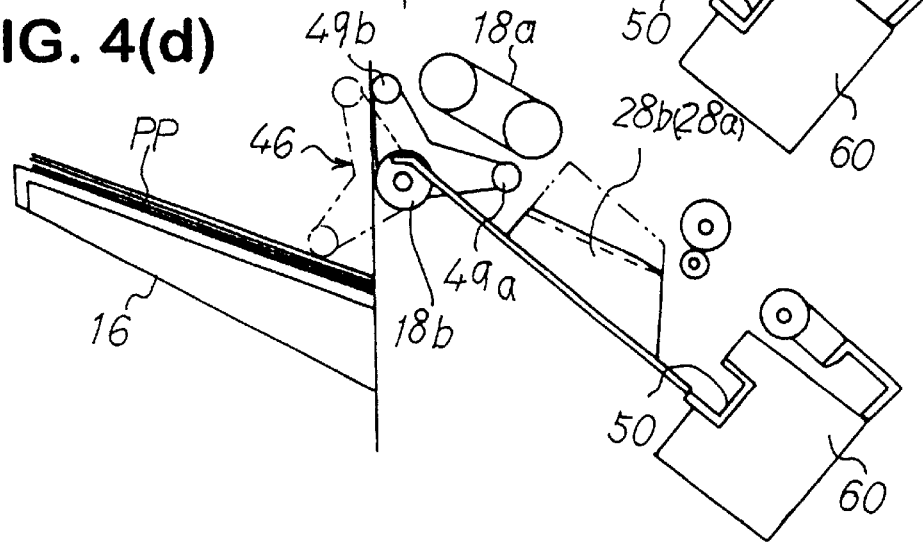

An embodiment of a sheet post-processing device according to the present invention is explained hereunder by referring to the drawings. The sheet post-processing device is a device which applies folding, binding, gluing, cutting or similar post-processing to a sheet to which an image forming process, such as printing and copying, is made, and as the embodiment of the post-processing device according to the present invention, a device of binding by a stapler is explained.

In FIG. 1, numeral 10 designates a pair of transfer rollers which constitute transfer means and include a sheet stopper 11 for guiding and receiving a rear edge of a sheet transferred along a transfer surface of the lower side roller. A pair of ejection rollers 18 as moving means ejects the sheet or a set of the sheets toward a storing tray 16 continuously disposed as a second tray on a downstream side of a sheet transfer path 12. Guide means 20 is disposed between the pair of the transfer rollers 10 and the pair of the ejection rollers 18 in the sheet transfer path 12.

Numerals 22*a*, 22*b* designate first and second control members constituting the guide means 20, and first and second aligning surfaces 28*a*, 28*b* are projected downwardly from inner rim edges of first and second flat surfaces 24*a*, 24*b* along a transfer surface of the sheet. Also, a plate like shift portion 26 stands vertically from the first flat surface 24*a*. Both of the control members 22*a*, 22*b* are disposed in symmetrical positions sandwiching the sheet transfer path 12 therebetween to face each other.

The first and second flat surfaces 24*a*, 24*b* constituting the guide means 20 are in the same plane, and by upwardly inclining downstream sides of both the flat surfaces 24*a*, 24*b*, a rear edge of the sheet, which is taken out from the pair of the transfer rollers 10 and guided onto both the flat surfaces 24*a*, 24*b*, is aligned and stably received on the sheet stopper 11, and can be held at a certain position without providing a retaining member in particular, so that the sheet can be transferred to the next step as it is without problems.

Also, the first and second aligning surfaces 28*a*, 28*b* have the same shape, and similarly project downwardly from the inner rim edges of the first and second flat surfaces 24*a*, 24*b*. The shift portion 26 and the first and second aligning surfaces 28*a*, 28*b* are respectively parallel with a plane which is perpendicular to the first and second flat surfaces 24*a*, 24*b*. Moreover, both the flat surfaces 24*a*, 24*b* are located above a process tray (a first tray) 30 which supports the lower surface of the sheet at the time of stapling, and the aligning surfaces 28*a*, 28*b* align both side surfaces of the process tray 30.

The first and second control members 22*a*, 22*b* are respectively screwed with driving screw members 31*a*, 31*b* independently having right and left screws, and appropriately transferred in the width direction of the sheet by a control motor (not shown) in known means, so that an interval therebetween can be freely changed, or a jog operation can be freely performed by simultaneously expanding or simultaneously closing in the directions opposite to each other. Especially, even if sheets have different sizes, this mechanism can be utilized in case of a center standard transfer path which equalizes center positions.

Figure 8:
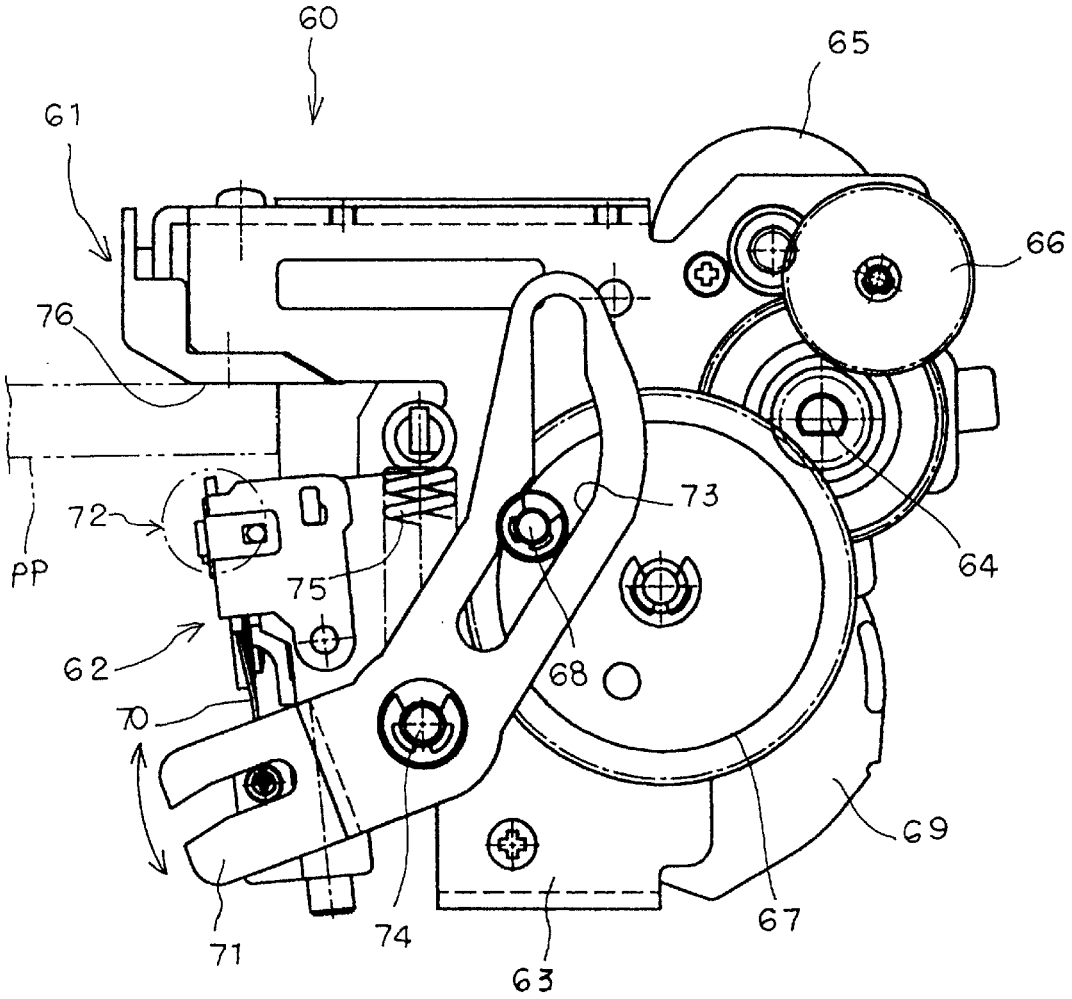
FIG. 8 is a sectional view of a side of a stapler device applied to the sheet post-processing device according to the present invention.

Next, operations of the aligning means of the sheet post-processing device according to the present invention are explained by referring to FIG. 3(*a*) through FIG. 8. In an initial stage of the post-process, the storing tray 16, on which the sheet is not placed, is located at a first position at the highest end, and also the pair of the ejection rollers 18 is widely and upwardly spaced away from a driving roller 18*b* which cooperates therewith such that a pinch roller 18*a*' for holding a sheet does not interfere the transferred sheet.

For example, a sheet ejected from a printer 40 of the image forming device passes through a guide path 42 while being urged by a pair of transfer rollers 44 on the way, and is transferred to the pair of the ejection rollers 18 as transferring means from the pair of the transfer rollers 10, and when the sheet completely escapes from engagement with the pair of the transfer rollers 10, a leading end portion of the sheet reaches a position over the driving roller 18*b* and stops. At this time, the leading end portion of the sheet is supported and received by a lever 48*a* of a sheet holding lever 46 controlled by a driving system which is different from that of the driving roller 18*b*, and a roller 49*a* pivotally supported at the distal end of the lever 48*a*.

No force other than gravity is acted on the sheet sent out from the pair of the transfer rollers 10, and the sheet is in a free condition. Due to various causes during printing and transferring, a posture of the sheet is not uniform, so that the sheet is transferred while deviating to a random position in the width direction. The aligning means is one which functions to operate position control in the width direction to the sheet in this condition.

In the following embodiment, by means of this aligning means, that is, the guide means 20, there are provided two use modes, whether a post-process is applied or the post-process is not applied to a set of sheet bound by stapling means such as the stapler device 60.

Figure 5A:
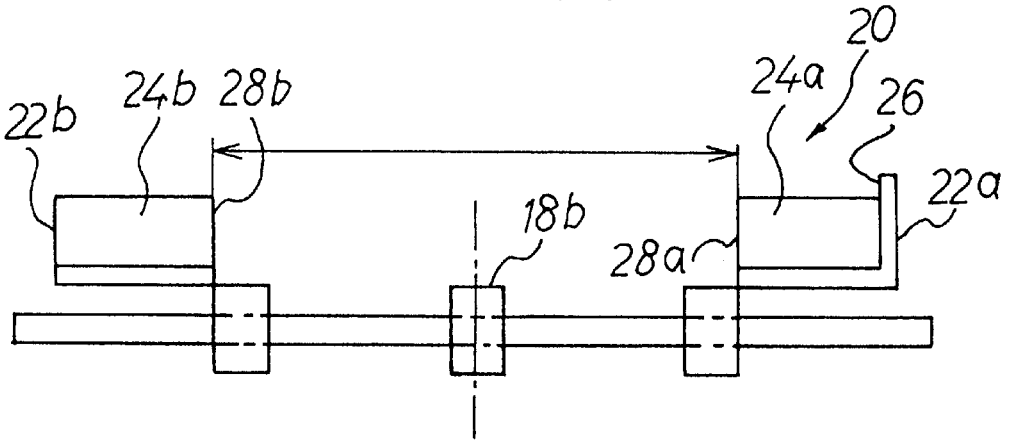
FIG. 5(*a*) and FIG. 5(*b*) are plan views explaining the first mode operation in the sheet post-processing device according to the present invention.
Figure 5B:
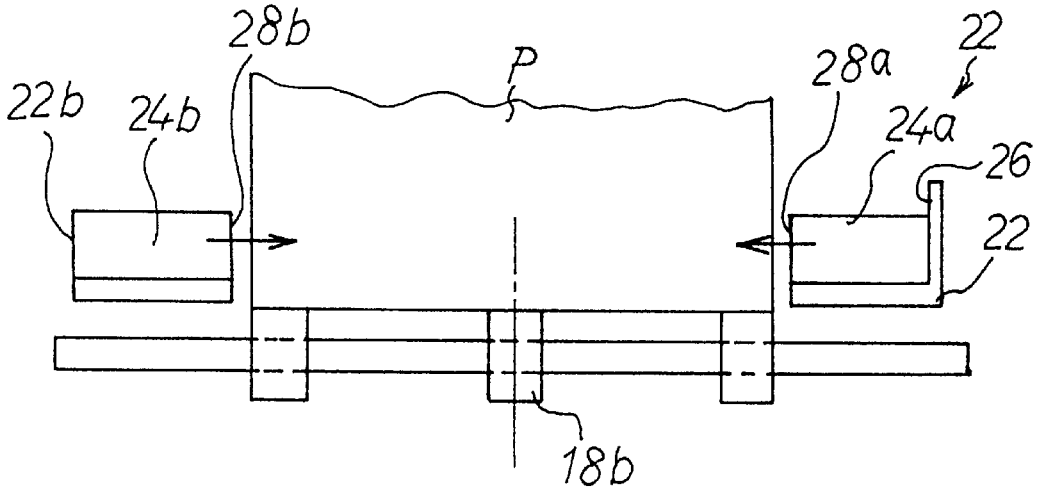
Figure 6A:
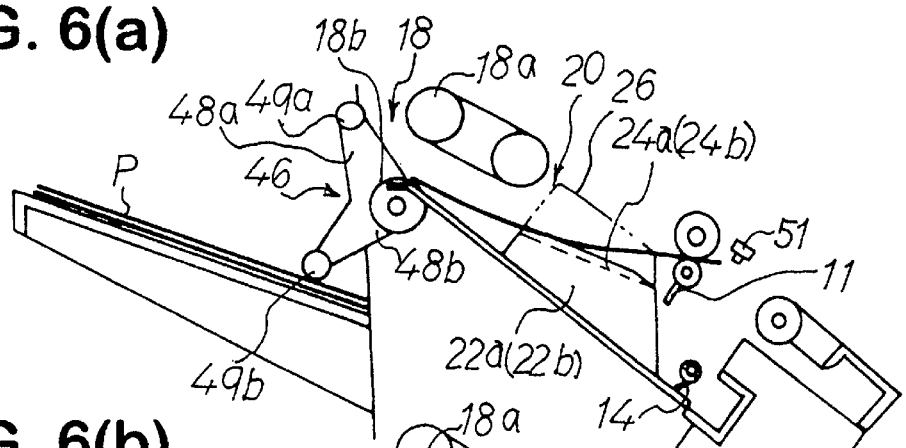
FIG. 6(*a*) through FIG. 6(*d*) are operation explanatory views of the aligning means of a second mode in the sheet post-processing device according to the present invention.
Figure 6B:
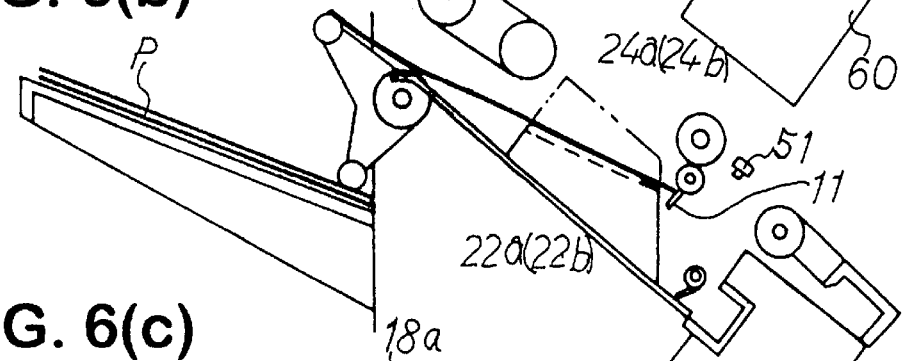
Figure 6C:
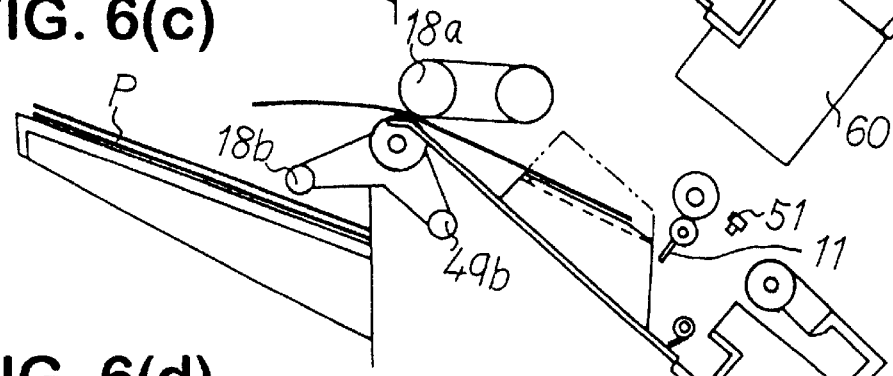
Figure 6D:
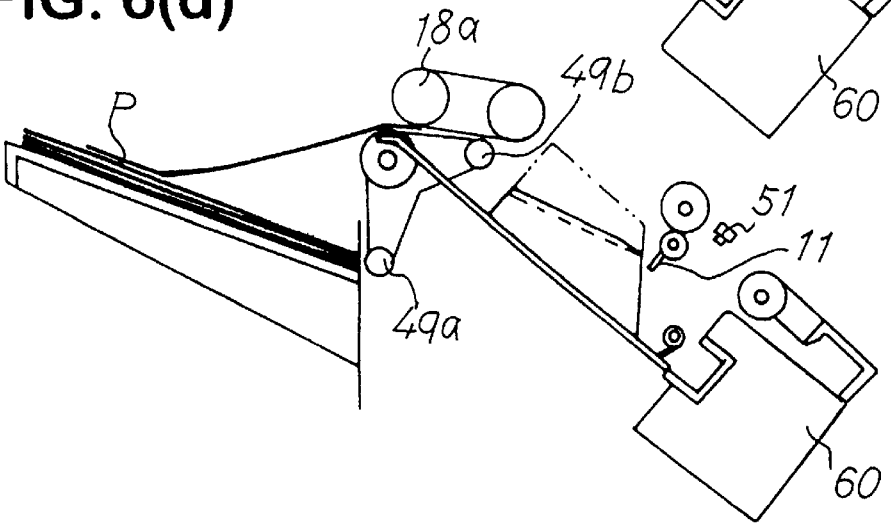
Figure 7A:
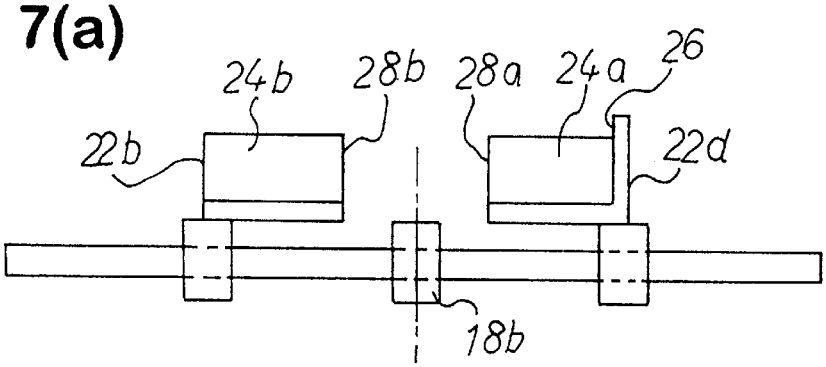
FIG. 7(*a*) through FIG. 7(*d*) are plan views explaining a second mode operation in the sheet post-processing device according to the present invention.
Figure 7B:
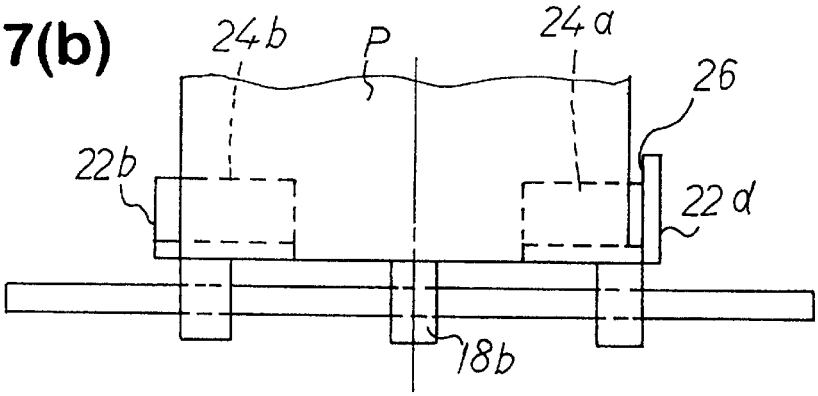
Figure 7C:
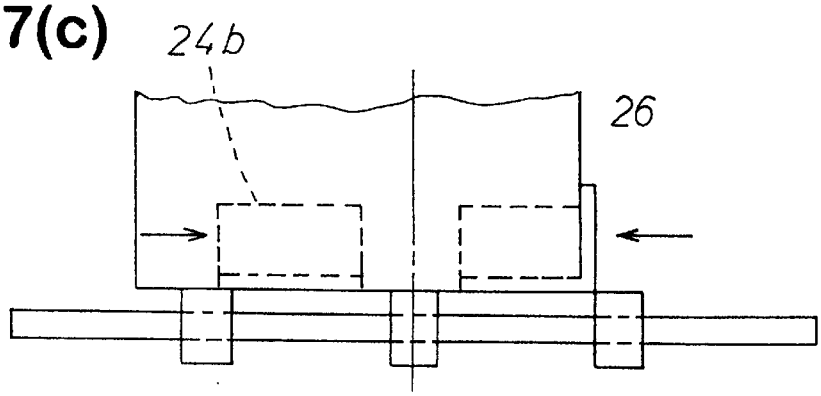
Figure 7D:
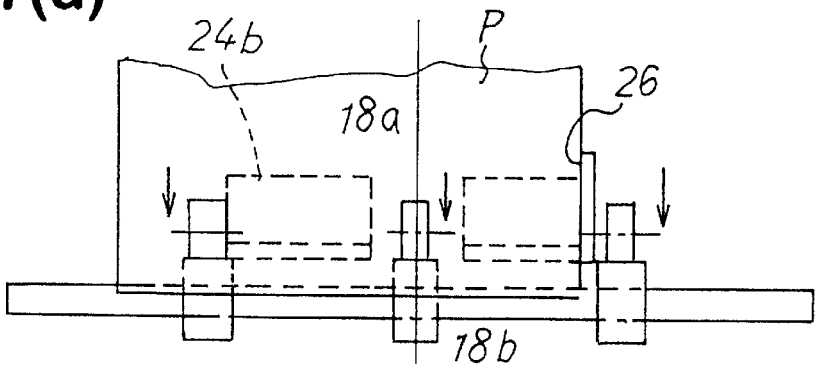

FIG. 3(*a*) through FIG. 5(*b*) show a case of a first mode in which a set of the sheets is stored after the post-process is applied to the sheets P stacked on the process tray 30, by being achieved by the following program. Namely, since an approximate transfer position of the sheet sent out from the pair of the transfer rollers 10 can be assumed according to applied sheet sizes and printer characteristic, the first and second control members 22*a*, 22*b* are disposed at the assumed transfer position, and at the same time, an interval between the aligning surfaces 28*a*, 28*b* is set slightly wider than the width of the sheet to stand by (referring to FIG. 5(*a*)).

Thus, the sheet P released from the pair of the transfer rollers 10 is stored in the process tray 30 while a forward end portion thereof passes through the driving roller 18*b* and is supported and received by the lever 48*a* of the sheet holding lever 46 and the roller 49*a* at the distal end of the lever, and the rest of the sheet surface freely drops between the aligning surfaces 28*a*, 28 (referring to FIG. 3(*a*) through (*c*)).

In this process, a control circuit (not shown) is programmed such that when the control circuit receives a signal of detecting a rear edge of the transferred sheet P from a sheet detecting sensor 51 disposed at a position which is an upper stream side than that of the pair of the transfer rollers 10 and slightly away from the rollers 10, and after a time lag until the sheet P settles down inside the process tray 30, the control circuit rotates a paddle 14, which is made of a soft rubber plate and disposed on the upstream side of the process tray 30 by one rotation, and outputs an actuation signal to a control motor for the driving screw members 31*a*, 31*b* so as to move the control members 22*a*, 22*b* in the closing direction. The paddle 14 elastically contacts with a front surface of the sheet P placed on the process tray 30, and the rear edge of the sheet is drawn into a stapling end alignment position 50 by a frictional force. On the other hand, the side edges of the sheet P are aligned in the predetermined width by the aligning surfaces 28*a*, 28*b* (referring to FIG. 5(*b*)).

At this time, it is possible to be programmed that the sheet holding lever 46, which supports and receives the forward end portion of the sheet, is slightly rotated clockwise, and much larger inclination is given to the sheet, so that the rear end edge of the sheet P is securely aligned at the stapling end alignment position 50 of the stapler device 60 (referring to FIG. 3(*d*)).

Then, the first and second control members 22*a*, 22*b* are returned to the standby position to receive the next sheet, and the paddle 14 stands by at a home position (referring to FIG. 3(*a*)) after making one rotation. By repeating this operation hereafter, the sheets are orderly stacked at the aligning position.

Also, if necessary, it can be structured such that the guide means 20 as a whole can be shifted in the width direction to enable the jog operation, so as to change the position of the set of the sheets in the sheet width direction for every set of the sheets. For example, by alternately shifting a binding position of the sheets P, it can be avoided that staple needles laminated on the storing tray 16 are accumulated at the same position.

On the other hand, the predetermined number of the sheets to be post-processed is set at a preset counter (not shown), and when detected times by the sheet detecting sensor 51 are counted and reach the set value, an actuation signal is sent to the stapler device 60 to staple the set of the sheets.

Then, as shown in FIG. 4, a program is set such that the pinch roller 18*a* of the pair of the ejection rollers 18 in the separate position at the initial stage is lowered, and when a set of sheets PP is nipped between the pinch roller 18*a* and the driving roller 18*b*, the pinch roller 18*a* and the driving roller 18*b* are actuated to eject the set of the sheets PP to the storing tray 16.

At this time, in response to a signal such that a sheet detecting sensor 52, which is disposed on the upstream side and adjacent to the pair of the ejection rollers 18, detects the set of the sheets PP, the sheet holding lever 46 makes one rotation from the home position shown in FIG. 4(*a*). Meanwhile, the levers 48*a*, 48*b* and the rollers 49*a*, 49*b* guide a rear end portion of the set of the sheets PP and place the same onto the storing tray 16.

The roller 49*b* engages an upper surface of the set of the sheets PP placed at the final end of the one rotation of the sheet holding lever 46, draws the rear edge of the set of the sheets PP up to the deep of the storing tray 16 as shown by a two-dotted chain line in FIG. 4(*d*), and stops at the home position again. At this moment, the roller 49*b* of the sheet holding lever 46 compulsorily pushes down the upper surface of the set of the sheets PP to the predetermined height. Hereafter, the program is repeated until a stop signal is outputted by an operator or until a stop signal is outputted since the storing tray 16 becomes full.

FIG. 6(*a*) through FIG. 7(*d*) show a case of a second mode of storing the sheet P in a single sheet and without being post-processed, and the pinch roller 18*a* of the pair of the ejection rollers 18 as transferring means is positioned at the initial position away upwardly from the driving roller 18*b*. Since a transferred position of the sheet can be approximately assumed according to an applied sheet size and printer characteristics as in the first mode, the first and second control members 22*a*, 22*b* are allowed to stand by at this assumed transfer position such that the interval between the aligning surfaces 28*a*, 28*b* is set to be sufficiently narrower than the width of the sheet (referring to FIG. 7(*a*)).

Accordingly, the sheet P released from engagement with the pair of the transfer rollers 10 moves under gravity on a plane formed by the flat surfaces 24*a*, 24*b* inclined upwardly on the downstream side, and makes the rear end thereof to abut against the sheet stopper 11 so as to be placed inside the shift portion 26 (referring to FIG. 7(*b*)). In this case, regardless of the process tray 30 (the first tray), the sheet goes directly to the storing tray 16 as the second tray; however, the sheet receives the jog operation on the way at an abutting surface of the shift portion 26, which abuts against the end portion of the sheet, and is shifted to the predetermined position (referring to FIGS. 7(*b*) and (*c*)). Alternatively, if the jog operation is not necessary, the sheet goes to ejection as it is. (The operation in FIG. 7(*c*) is omitted.)

In this step, when the rear end of the transferred sheet P is detected by the sheet detecting sensor 51 disposed at a proximity position on the upperstream side than the pair of the transfer rollers 10, the pinch roller 18*a* descends in appropriate timing to nip the sheet P with the driving roller 18*b* and transfer the same in cooperation therewith, and ejects the sheet on the storing tray 16. Meanwhile, the sheet holding lever 46 makes one rotation by avoiding interference with the sheet P.

The stop position as a start point of the sheet holding lever 46 is shown as the home position in FIG. 6(*a*). When the sheet holding lever 46 is at the final end of the rotation, the roller 49*b* engages with the upper surface of the set of the stacked sheets P, and draws the rear end of the set of the sheets P up to the deep of the storing tray 16 to stop. When the sheet holding lever 46 returns to the home position, the roller 49*b* compulsorily pushes down the upper surface of the set of the sheets P to the predetermined height. On the other hand, the pinch roller 18*a* returns to the initial position. Hereafter, the program is repeated until the stop signal is outputted by the operator or until the stop signal is outputted since the storing tray 16 becomes full.

On the other hand, the predetermined number of the sheets to be bound is set at the preset counter (not shown), and when the detected times by the sheet detecting sensor 51 are counted and reach the set value, the actuation signal is outputted to the control motor for driving the first control member 22*a* in which the shift portion 26 is formed to project, and depending on necessity, a position of the set of the sheets is changed set by set properly in the width direction so as to provide a program which enables to distinguish the respective sets of the sheets.

Incidentally, as a noteworthy point, although sheets are stacked in the process tray 30 in the first mode according to the above explanation, without concerning whether it is caused by trouble of the stapler device 60 or the process is not necessary, in case of ejecting without stapling operation, it is structured that the aligning surfaces 28*a*, 28*b* are capable of shifting (right and left independent driving or the like, omitted in the figure), and it is easily assumed that by performing shifting operation, a result of staking on the storing tray 16 is the similarly jogged one. However, in jog ejection using this first mode, time for landing the sheet onto the process tray 30 is wasteful, so that productivity is impaired as described above. Therefore, the second mode is effectual.

In the following, an embodiment of the stapler device applied to the sheet post-processing device of the invention is explained. FIG. 8 is a sectional view of a side surface of the stapler device 60, which is formed of a bench unit 61 necessary for bending the staple needle, and a drive unit 62 necessary for driving the staple needle into the set of the sheets PP. A rotational shaft 64 of the drive unit 62 is fixed to a bench frame 63 surrounding the bench unit 61, and the drive unit 62 pivotally supported by the rotational shaft 64 is freely rotatable.

A rotational force of a driving motor 65 is transmitted to a sequence gear 67 through a three-step gear train 66. A sequence pin 68 is disposed to project in the sequence gear 67, and controls opening and closing the drive unit 62 with respect to the bench unit 61.

On the other hand, a driver 70, which drives a staple needle appearing from a staple cartridge 69 into the set of the sheets PP, cooperates with swing of a drive arm 71, and strikes the staple needle from a striking portion 72 of the drive unit 62 into the set of the sheets.

The drive arm 71 engages with the sequence pin 68 through an elongated hole 73, and is freely rotatable on a rotational shaft 74; and when the sequence pin 68 makes one rotation, the drive arm 71 carries out one cycle of ascending and descending. The rotational shaft 74 of the drive arm 71 is freely slidable inside a not shown elongated hole disposed in the bench frame 63, and is supported by urging of a pulling and extending spring coil 75 which is extended between the rotational shaft 74 and the bench frame 63.

When the driving motor 65 is actuated in response to the signal, the drive unit 62 rotates on the rotational shaft 64, and the striking portion 72 at a distal end thereof approaches a bench 76 to press the set of the sheets PP against the bench 76. Then, the sequence pin 68 rotates the drive arm 71 to actuate the driver 70, and a distal end thereof sticks the staple needle from a lower surface of the set of the sheets PP, drives the same toward the bench 76, and further, bends the needle. At this time, a position of the rotational shaft 74 of the drive arm 71 urged by the tensile coil spring 75 varies in accordance with the thickness of the set of the sheets PP. While slidingly contacting inside the elongated hole 73, the sequence pin 68 further rotates, and at the time of finishing one cycle, the drive arm 71 is returned to a standby position (home position) as the starting point.

As explained above, in the sheet post-processing device according to the present invention, in case the post-process is not necessary, the path is guided and stacking onto the process tray is bypassed, so that time for landing sheets onto the process tray can be saved and productivity can be significantly improved.

And, since the sheet support portion of the guide means is formed flat, and the downstream side thereof is upwardly inclined, the sheet is stably supported and can be securely transferred to the next step.

Also, an upper side portion and a lower side portion of the flat surface can be properly used for two aligning modes respectively; in the aligning mode at the upper side portion, sheets are aligned by the jog operation of the upper aligning surface disposed at only one of the control members; and in the aligning mode at the lower side portion, aligning can be operated from both side surfaces of the set of the sheets by the alining surfaces.

What is claimed is:

1. A sheet post-processing device, comprising:

a process tray having a sheet placing surface for stacking a sheet thereon, ejecting means for ejecting a sheet from an image forming device onto the process tray, post-processing means for post-processing the sheet on the process tray, a storing tray for storing the sheet post-processed by the post-processing means, moving means for transferring the sheet on the process tray to the storing tray, and guide means for guiding the sheet ejected from the ejecting means, said guide means being moved having a function to guide the ejected sheet to the moving means at a position spaced from the sheet placing surface of the process tray.

2. A sheet post-processing device according to claim 1, wherein the guide means includes a flat surface for supporting a lower surface of the sheet from the ejecting means to guide the sheet to the moving means.

3. A sheet post-processing device according to claim 1, wherein the guide means includes an aligning surface for abutting against an end portion of the sheet on the process tray to align the sheet.

4. A sheet post-processing device according to claim 1, wherein the guide means moves between a retreating position for enabling to place the sheet on the process tray and a support position for guiding the sheet from the ejecting means to the moving means.

5. A sheet post-processing device according to claim 2, wherein the guide means have means to freely move along the sheet placing surface of the process tray.

6. A sheet post-processing device having a storing tray for storing a sheet and a process tray having a sheet placing surface for post-processing the sheet, said sheet post-processing device including a first mode for guiding the sheet from an image forming device to the storing tray and a second mode for guiding the sheet from the image forming device to the process tray, and guiding the sheet to the storing tray after predetermined post-processing is operated, wherein said sheet post-processing device further comprises guide means for guiding the sheet from the image forming device to guide the sheet to the storing tray at a position spaced from the sheet placing surface of the process tray and to reach the storing tray, said guide means being transferred to a position for guiding the sheet to the storing tray in case of the first mode, said guide means being transferred to a position to guide the sheet to be placed on the sheet placing surface of the process tray in case of the second mode.

7. A sheet post-processing device according to claim 6, wherein said position for guiding the sheet to the storing tray in case of the first mode is changed according to a size of the sheet from the image forming device.

8. A sheet post-processing device according to claim 6, wherein said position of the guide means in case of the second mode is changed according to a size of the sheet from the image forming device.

9. A sheet processing device, comprising:

a process tray having a sheet placing surface for stacking a sheet thereon, ejecting means for ejecting a sheet from an image forming device onto the process tray, post-processing means for post-processing the sheet on the process tray, a storing tray for storing the sheet post-processed by the post-processing means, moving means for transferring the sheet on the process tray to the storing tray, and guide means for moving the sheet ejected from the ejecting means in a direction perpendicular to a sheet ejecting direction at a position spaced from the sheet placing surface of the process tray and guiding the sheet to the moving means.

10. A sheet post-processing device according to claim 9, wherein a moving amount of the guide means is controlled such that a storing position of the sheet from the image forming device in the storing tray is changed every predetermined number of sheets.

11. A sheet post-processing device according to claim 9, wherein the moving means is formed of a pair of movable rotation members, said pair of the rotation members being separated from each other so as to pass a forward end of the sheet guided by the guide means, said rotation members abutting against each other after the sheet is transferred to the direction perpendicular to the sheet ejection direction by the guide means, so as to transfer the sheet to the storing tray.

12. A sheet post-processing device according to claim 9, wherein the guide means includes a flat surface for supporting a lower surface of the sheet from the ejecting means to guide the sheet to the moving means, and an abutting surface for abutting against an end portion of the sheet supported by the guide means and transferring the sheet in accordance with moving of the guide means.

* * * * *